US008616592B2

(12) United States Patent
Kitada et al.

(10) Patent No.: US 8,616,592 B2
(45) Date of Patent: Dec. 31, 2013

(54) LATCH DEVICE OF A DOOR

(75) Inventors: Kazuhiko Kitada, Yokohama (JP); Yutaka Sugihara, Yokohama (JP)

(73) Assignee: Okamura Corporation, Kanagawa (JP)

( * ) Notice: Subject to any disclaimer, the term of this patent is extended or adjusted under 35 U.S.C. 154(b) by 1021 days.

(21) Appl. No.: 12/093,392

(22) PCT Filed: Nov. 7, 2006

(86) PCT No.: PCT/JP2006/322169

§ 371 (c)(1),
(2), (4) Date: May 12, 2008

(87) PCT Pub. No.: WO2007/055200

PCT Pub. Date: May 18, 2007

(65) Prior Publication Data

US 2009/0115198 A1 May 7, 2009

(30) Foreign Application Priority Data

Nov. 10, 2005 (JP) ..... 2005-326098
Nov. 14, 2005 (JP) ..... 2005-329319

(51) Int. Cl.
*E05B 15/02* (2006.01)

(52) U.S. Cl.
USPC ..... 292/198; 292/336.3

(58) Field of Classification Search
USPC ..... 292/198, 1, 336.3, 200, 52
See application file for complete search history.

(56) References Cited

U.S. PATENT DOCUMENTS 5,098,141 A * 3/1992 Bull ..... 292/252
5,586,458 A * 12/1996 Weinerman et al. ..... 70/208
6,578,884 B2 * 6/2003 Chiang ..... 292/66
7,452,010 B2 * 11/2008 Cotton ..... 292/66

FOREIGN PATENT DOCUMENTS

CH 191794 A 9/1937
DE 2659299 A1 7/1977
FR 1483125 A 6/1967

(Continued)

OTHER PUBLICATIONS

Supplementary European Search Report for corresponding European Application No. EP06823082, dated Jan. 2, 2012.

*Primary Examiner* — Carlos Lugo
*Assistant Examiner* — Mark Williams
(74) *Attorney, Agent, or Firm* — Sughrue Mion, PLLC

(57) ABSTRACT

A simply structured and smoothly operable latch device of a door in which a latch can be infallibly released by operating a handle from any of upper, lower, right, and left sides. The handle (1) having operation parts (1*e*) at the upper, lower, left, and right inner edges of the front opening part thereof is received in a handle receiving part (14) formed in a door (3) and having an opening in its front surface. The handle (1) can be moved to a non-operating position where the rear surface of the handle abuts on the rear end surface of the handle receiving part (14) or to an operating position where the handle (1) is tilted so that one of the upper and lower edges or one of the left and right edges is nearer to the person operating the handle (1) than the other. The handle (1) is biased toward the non-operating position by a spring (17), and the handle (1) and the latch are linked with each other by a linkage means (34) so that the latch can be moved to the non-engaging position when the handle (1) is moved to the operating position.

6 Claims, 17 Drawing Sheets

(56) References Cited

FOREIGN PATENT DOCUMENTS

| | | | |
|---|---|---|---|
| GB | 729045 | A | 5/1955 |
| GB | 1119102 | A | 7/1968 |
| JP | 63-96177 | U | 6/1988 |
| JP | 8-266348 | A | 10/1996 |
| JP | 9-322833 | A | 12/1997 |
| JP | 10-231649 | A | 9/1998 |
| JP | 2004-332504 | A | 11/2004 |
| JP | 2005-126967 | A | 5/2005 |
| JP | 2005-200980 | A | 7/2005 |

* cited by examiner

LATCH DEVICE OF A DOOR

TECHNICAL FIELD

The present invention relates to a latch device of a door in which a latch engages with and disengages from a housing when the door closes, a handle in a front panel of the door enabling a latch to engage with and disengage from the housing.

JP8-266348A discloses a door latch in which a handle pivotally mounted to a door is pulled to allow the handle to turn in one direction to release latch.

JP2004-332504A and JP63-96177U disclose that a latch is released by turning a handle from right and left or upper and lower directions.

However, the handle is limited to turn in one or two directions to make it impossible to release latch even if the handle is operated from other directions.

For example, in a storage system where a plurality of cabinets or lockers are piled up and arranged side by side, a handle at a higher position of a door for the cabinet is preferably operated from a lower position, and a handle at a lower position of the door is preferably operated from a higher position. A handle for a door at an intermediate-height position is preferably operated from a right or left direction to allow the latch to be released. All the handles should have the same structure and the same design.

To satisfy the requirements, handles are desirably operated from all directions for releasing latch.

SUMMARY OF THE INVENTION

In view of the disadvantages, it is an object of the present invention to provide a door latch in which a handle is operated from any directions to allow latch to be released, its structure being simple and operable smoothly.

DETAILED DESCRIPTION OF PREFERRED EMBODIMENTS

Embodiments of the invention will be described with respect to the drawings.

Figure 1:
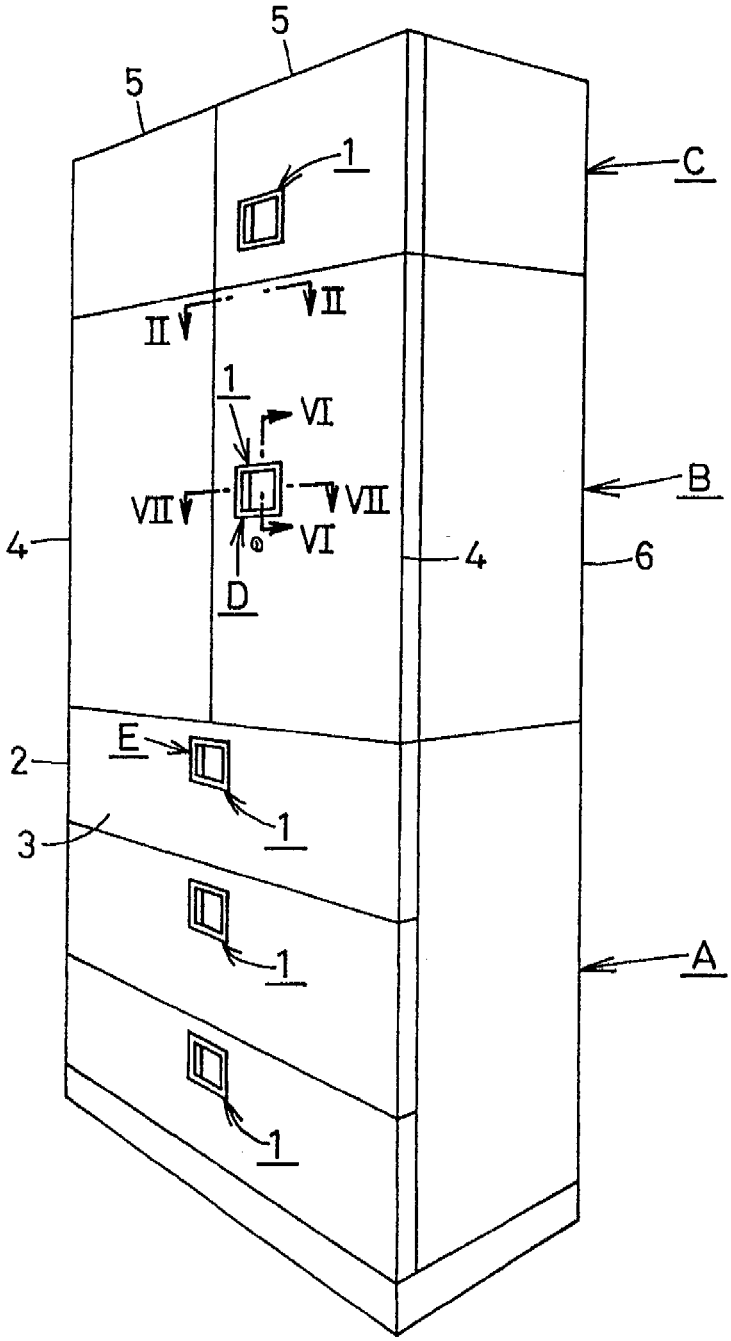
FIG. 1 is a perspective view of a storage system in which three cabinets A, B, C are piled up, each including a latch device of a door according to the present invention.

FIG. 1 shows a storage system in which three cabinets A, B, C are piled up, each having a latch device of a door.

The handles 1 for the cabinets A, B, C are all the same in structure and design. The latch devices including the handle 1 differ from each other in structure to comply with the cabinets A, B, C.

The cabinet A comprises three-stage drawers and the handle 1 is provided in the middle of a front panel of each of the drawers 2.

The cabinet B is a double-door type, and the right-hand door 4 has a handle 1.

Then, a latch device D of the cabinet B will be described in detail with respect to FIGS. 2-7 as the first embodiment of the present invention. Then, a latch device E of the cabinet A will be described with respect to FIGS. 8-10 as the second embodiment of the present invention.

A latch device of the cabinet C has substantially the same structure as the latch device D of the cabinet D except partial size and description thereof is omitted.

In the cabinet B in FIGS. 2-5, the right-hand door 4 is pivotally mounted to a right side of a housing 6 with a hinge (not shown). A vertical rectangular latch shaft 7 is pivotally mounted in a left-hand side of the right-hand door 4. At the upper and lower ends of the latch shaft 7, the proximal end of the latch 8 is fixed.

Figure 2:
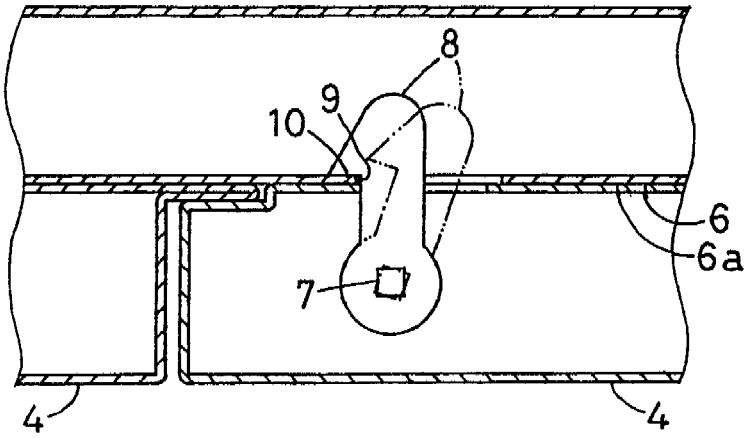
FIG. 2 is an enlarged horizontal sectional view taken along the line II-II in FIG. 1.

In FIG. 2, the latch 8 projects rearward from the door 4 with a hooked rear end. When the door 4 is closed, the latch 8 engages in a hole 9 in the front surface of a top rail 6*a*. A lower latch 8 is disposed in a bottom rail (not shown).

In FIGS. 3 to 7, a square opening 11 for operating the handle 1 is formed in the front surface of the right-hand door 4, and a box-like handle storage case 12 is disposed behind the opening 11. Vertical and horizontal distances of a front opening of the handle storage case 12 are larger than those of the opening 11. When the handle storage case 12 is mounted in the door 4, the peripheral edge of the door 4 around the opening 11 is formed as an inward brim 13 projecting inward in the front opening of the handle storage case 12.

By the inward brim 13 and handle storage case 12, the handle 1 is stored to move between a rest position where its rear end face abuts on the bottom of the handle storage case 12, and a working position where the handle 1 is tilted to allow one end to be ahead of the other end in a rectangular handle storage portion 14.

The handle 1 comprises a rectangular portion 1*a* having an opening; a brim 1*b* which is corresponding to the inner surface of the handle storage case 1*b*; and an operating part 1*e* which comprises an inward portion 1*c* and a rectangular projection 1*d*.

The upper parts of the rectangular portion 1*a* are partially cut off at four corners to form a corner-cutout-flat portion 1*f*.

An operating rod 15 is pivotally mounted under the handle storage case 12. The upper ends of a pair of handle holding portions 16,16 extending from the ends of the operating rod 15 contact the front surfaces of the corner-cutout-flat portion 1*f*.

A coil spring 17 is wound on the middle of the operating rod 15. One end of the winding of the coil spring 17 engages in an engagement piece 18 fixed to the middle of the operating rod 15. The other end of the winding engages on the lower edge of the handle storage case 12. Thus, the operating rod 15 is urged by the coil spring 17 so that the ends of the handle holding portions 16,16 can rotate to push the lower corner-cutout-flat portions 1*f*, 1*f* rearward.

The handle 1 is pressed rearward by the handle holding portions 16,16 when it is not operated, and held in the rest position where the brim 1*b* contacts the rear end face of the handle storage portion 14.

Three arms 19,20,21 are fixed to the latch shaft 7 at suitable intervals vertically. The upper arm 19 abuts on the front surface of the upper-left corner-cutout-flat portion 1*f* of the handle 1. The middle arm 20 abuts on the front surface of the left handle holding portion 16.

The latch shaft 7 is urged to rotate to press the handle 1 with the arms 19,20 directly and to press the handle 1 with the handle holding portion 16 indirectly by a coil spring (not shown). When the handle 1 is in the rest position, the latch shaft 7 is positioned in an engagement position where the latch 8 engages on the engagement portion 10 as shown by a solid line in FIG. 2.

A key (not shown) is put into a cylinder lock 22 in the front panel of the door 4 to turn the cylinder lock 22, allowing a dead bolt 23 to move leftward. Thus, the left end of the dead bolt 23 gets in a turning track of the cylinder lock 21 for locking, or gets out of the turning track for unlocking.

In the embodiment, there is a connecting unit 24 for connecting the handle 1 to the latch 8 in which with the operating rod 15 having the handle holding portions 16,16 and with the latch shaft 7 having the arms 19,20 the handle 1 moves the latch 8 to a disengaged position where the latch 8 disengages from the engagement portion 10 of the housing 6. A latch device D comprises the latch 8, connecting unit 24, handle storage case 12, handle 1 and coil spring 17.

A operation of the embodiment will be described.

Figure 6A:
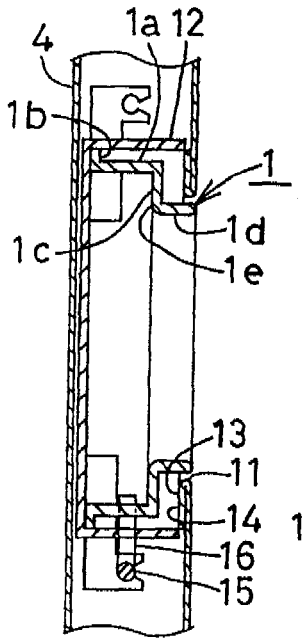
FIG. 6A is a vertical sectional side view taken along the line VI-VI in FIG. 1 when the handle is not operated.
Figure 6B:
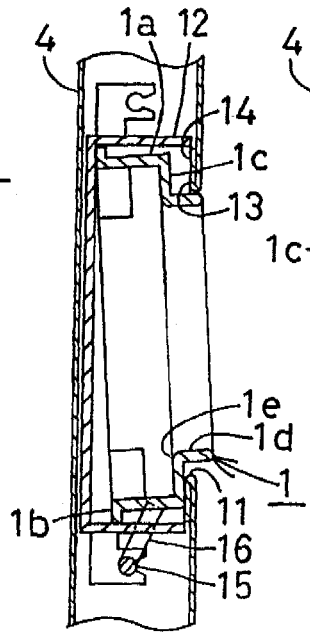
FIG. 6B is a vertical sectional side view taken along the line VI-VI in FIG. 1 when the lower part of the handle is pulled.
Figure 7A:
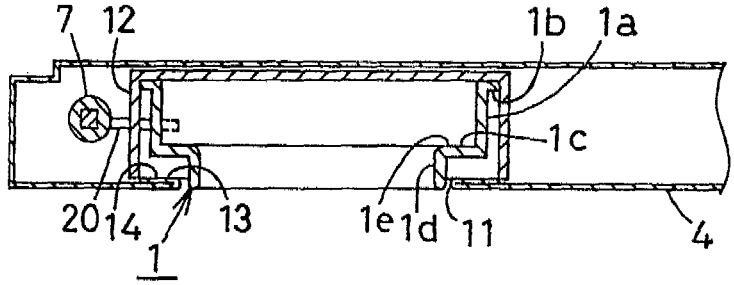
FIG. 7A is a vertical sectional plan view taken along the line VII-VII in FIG. 1 when the handle is not operated.

When the handle 1 does not work, it is in the rest position in FIGS. 6A and 7A, and the latch 8 and latch shaft 7 are in the engagement position by the solid line in FIG. 2.

From this position in FIG. 6A, the operating portion 1*e* of the handle 1 is pulled, the handle 1 is tilted on the upper rear end as pivot to allow the lower end to move forward until the front lower end of the rectangular portion 1*a* contacts the rear surface of the lower brim 13 to the working position where the lower edge is ahead of the upper edge.

When the lower end of the handle 1 moves forward, the handle holding portions 16,16 are turned by the corner-cut-out-flat portions 1*f*,1*f* of the handle 1 against the torsion coil spring 17. The left-hand handle holding portion 16 turns to allow the middle arm 20 to turn forward. Thus, the latch 8 and the latch shaft 8 turn to the disengaged position where they disengage from the engaged portion 10 as shown by a dotted line in FIG. 2 to allow the door 4 to open.

Figure 7B:
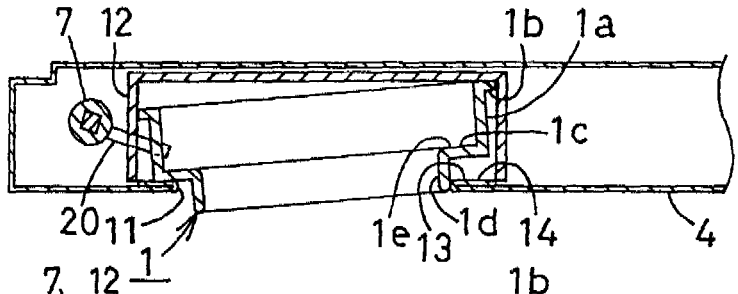
FIG. 7B is a vertical sectional plan view taken along the line VII-VII in FIG. 1 when the left part of the handle is pulled.
Figure 7C:
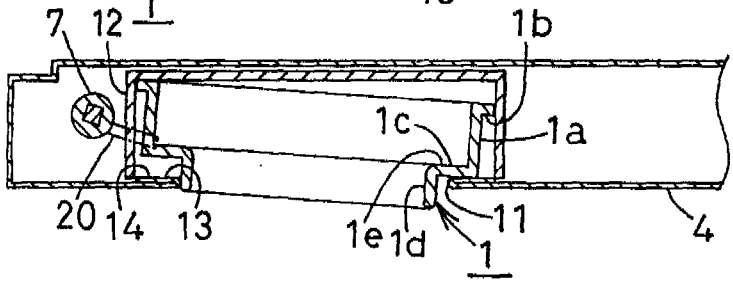
FIG. 7C is a vertical sectional plan view taken along the line VII-VII in FIG. 1 when the right part of the handle is pulled.

When the left-hand part of the operating portion 1*e* of the handle 1 is pulled in FIG. 7B and when the right-hand part is pulled in FIG. 7C, one of the right and left ends of the rectangular portion 1*a* contacts the rear surface of the brim 13 of the opening 11.

With tilting of the handle 1, one of the right and left handle holding portions 16 is turned by one of the lower corner-cutout-flat portions 1*f* forward and downward. Then, the latch 6 turns to the disengaged position as well as in FIG. 6B to allow the door 4 to open.

Figure 6C:
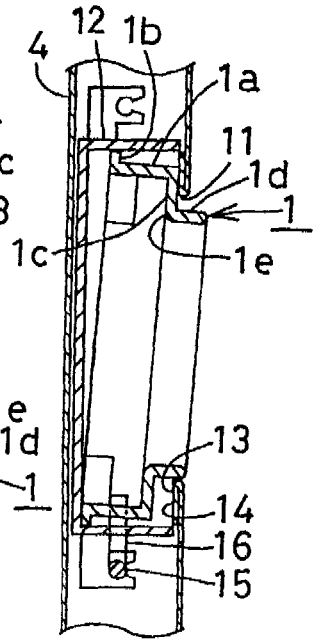
FIG. 6C is a vertical sectional side view taken along the line VI-VI in FIG. 1 when the upper part of the handle is pulled.

In FIG. 6C, when the upper operating portion 1*e* of the handle 1 is pulled, the upper end is tilted forward about the rear lower end as pivot until the upper front end of the rectangular portion 1*a* contacts the rear surface of the upper brim 13.

The end of the upper arm 19 turns forward by the upper left corner-cutout-flat portion 1*f* of the handle 1 and the latch shaft 7 and latch 8 turns to the disengaged position to allow the door 4 to open.

Accordingly, when any one of the upper, lower, right-hand and left-hand operating portions 1*e* is pulled, the handle 1 is tilted to allow the latch 8 to move the disengaged position. Whenever the handle 1 is operated from any one of upper, lower, right and left directions, the latch 8 can surely be released to provide more convenient use.

Figure 8:
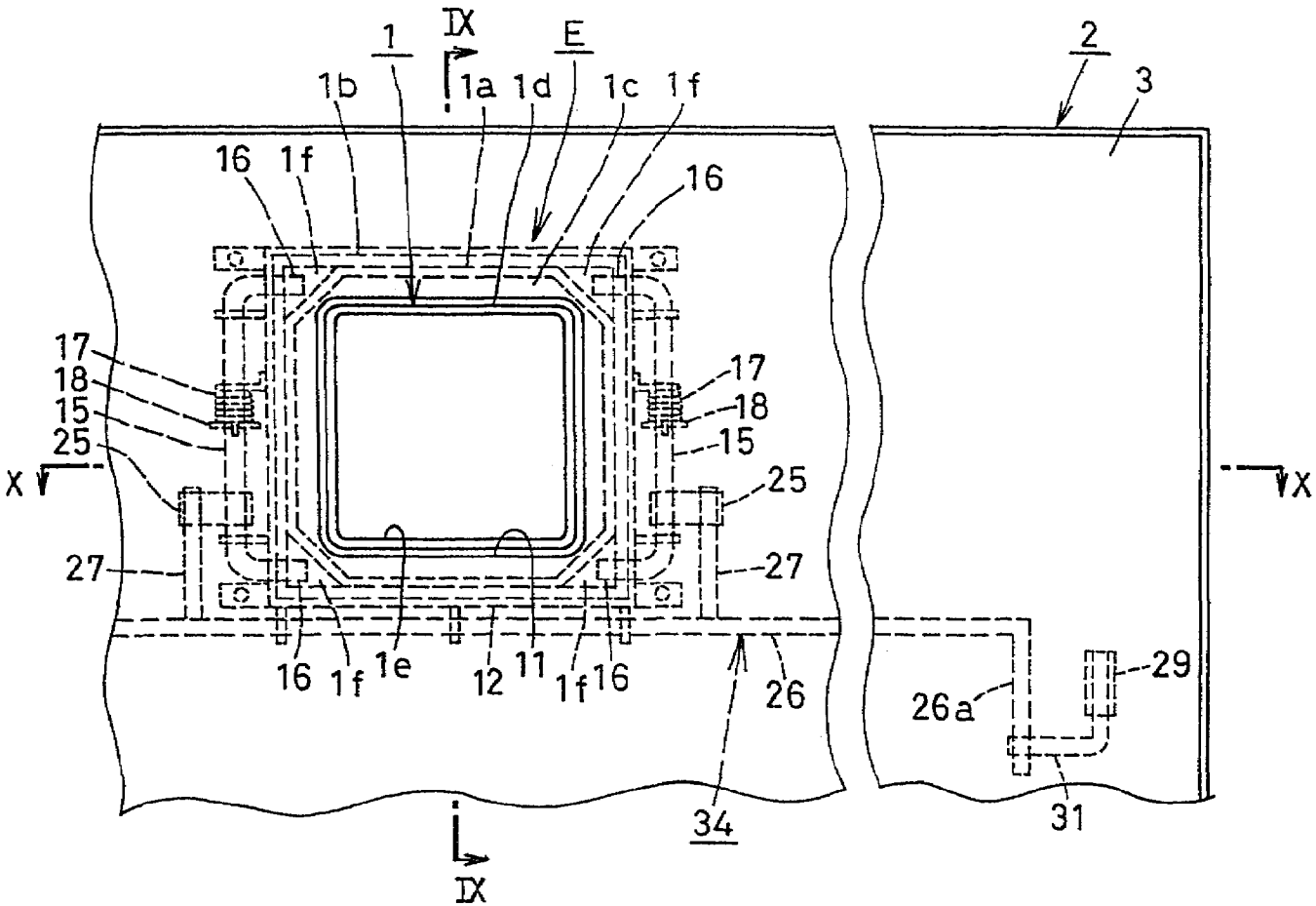
FIG. 8 is an enlarged front view of a handle on the front surface of a drawer of the cabinet A in the second embodiment according to the present invention.
Figure 9A:
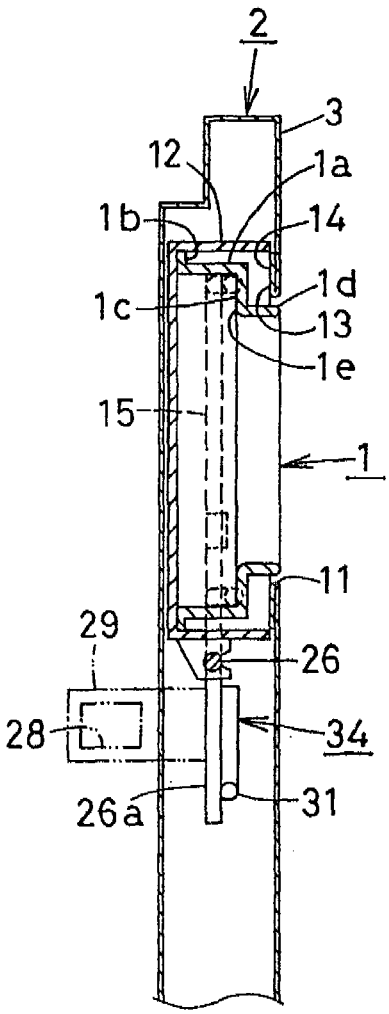
FIG. 9A is a vertical sectional side view taken along the line IX-IX in FIG. 8 when the handle is not operated.
Figure 9B:
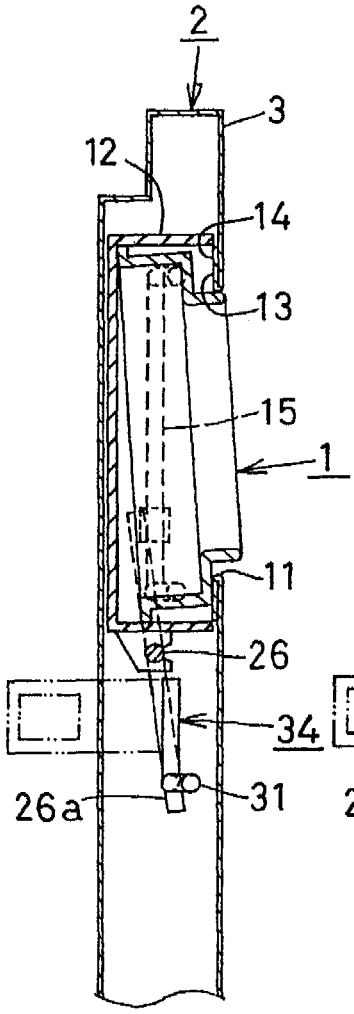
FIG. 9B is a vertical sectional side view taken along the line IX-IX in FIG. 8 when the lower part of the handle is pulled.
Figure 9C:
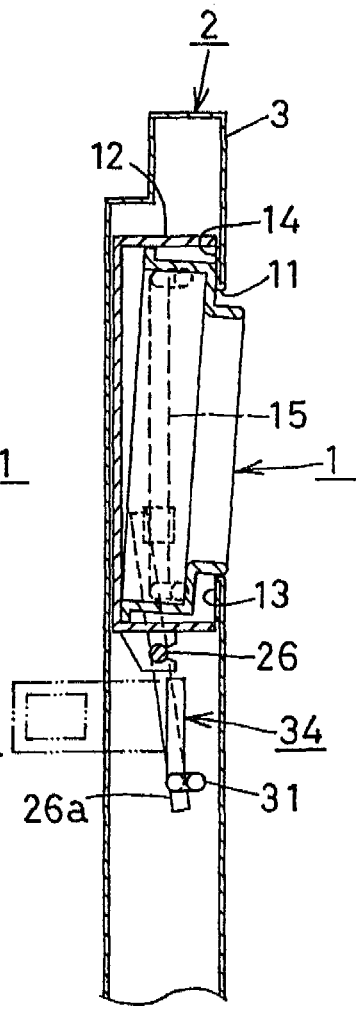
FIG. 9C is a vertical sectional side view taken along the line IX-IX in FIG. 8 when the upper part of the handle is pulled.
Figure 10A:
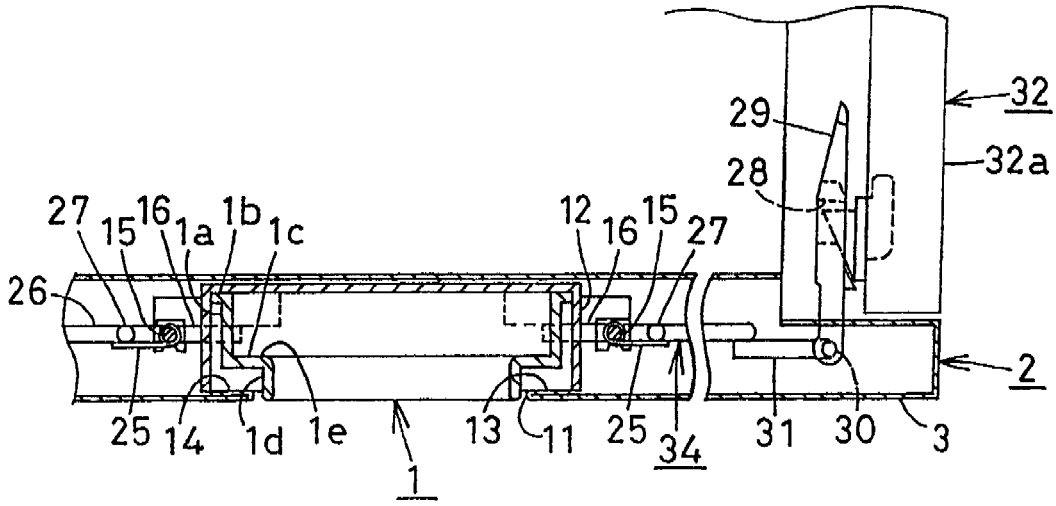
FIG. 10A is a vertical sectional plan view taken along the line X-X in FIG. 8 when the handle is not operated.
Figure 10B:
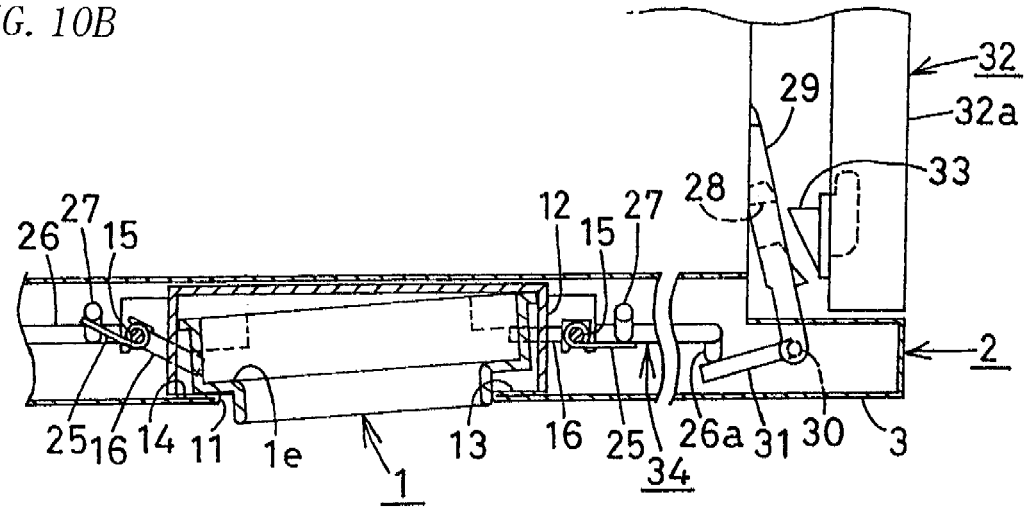
FIG. 10B is a vertical sectional plan view taken along the line X-X in FIG. 8 when the left part of the handle is pulled.
Figure 10C:
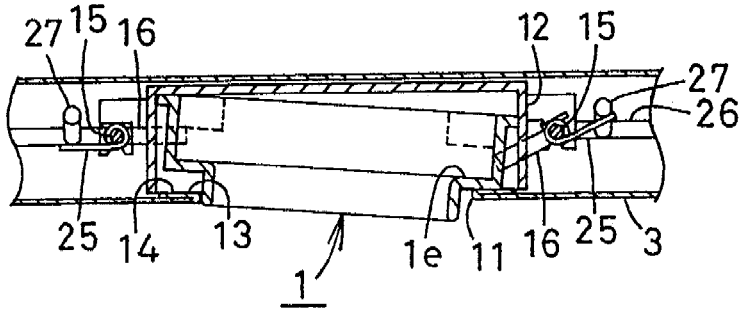
FIG. 10C is a vertical sectional plan view taken along the line X-X in FIG. 8 when the right part of the handle is pulled.

In FIGS. 8-10, a latch device E in the second embodiment of the present invention is provided in a front panel 3 of each drawer 2 of the cabinet A.

The latch device E includes the same elements as those in the latch device D in the first embodiment with the same numerals and description thereof will be omitted. Only different elements will be described in detail. The other embodiments will be described as well.

In the latch device E, an opening 11 is formed in the middle of the front panel 3 and a handle storage case 12 is provided behind the opening 11. A rectangular handle storage portion 14 is formed in the case 12 and a handle 1 is stored in the portion 14 to tilt between a rest position and a working position. At each side of the handle 1 in the front panel 3, a pair of vertical operating rods 15,15 and torsion coil springs 17,17 are provided. The ends of upper and lower holding portions 16,16 extending from the upper and lower ends of each of the operating rods 15 contact the front surfaces of four corner-cutout-flat portions 1*f* of the handle 1.

A pair of projections 25,25 is fixed to the right and left operating rods 15,15.

Below the handle storage case 12 in the front panel 3, an operating shaft 26 extends horizontally and has a downward portion 26*a*,26*a* at each end.

The operating shaft 26 has a pair of arms 27,27 each end of which is behind the projection 25.

At each side of the front panel 3, a latch 29 projects from the front panel 3 rearward, has an engagement hole 28 and is pivotally mounted on a vertical shaft 30.

At the front end of the latch 29, an arm 31 turns together with the latch 29. The arm 31 turns forward by the bent portion 26*a* of the operating shaft 26. The latch 29 is pivoted from an engagement position where a hole 28 engages with a projection 33 fixed to the inner surface of a side panel 32*a* of the housing 32 in FIG. 10A to a disengaged position where the engagement hole 28 disengages from the projection 33.

The latch 29 is always urged toward the engagement position by a spring (not shown).

In the second embodiment, there is a connecting unit 34 connecting the handle 1 to the latch 29, comprising a pair of operating rods 15 comprising handle holding portions 16,16 and projection 25, and an operating shaft 26 comprising the arms 27,27 and bent portions 26*a*,26*a*. Thus, motion of the handle 1 to the working position allows the latch 29 to got to a disengaged position where the latch 29 disengages from the projection 33 of the housing 32. A latch device E comprises the latch 29, connecting unit 34, handle storage case 12, handle 1 and torsion coil spring 17.

Then, an operation of the latch device E will be described.

When the handle 1 does not operate, it is in a rest position in FIGS. 9A and 10A where the latch 29 engages with the projection 33.

From this position, in FIG. 9B, the operating portion 1*e* at the lower part of the handle 1 is pulled. The handle 1 is tilted to allow the lower end to move forward about the upper rear end to the working position where the lower edge is ahead of the upper edge until lower front end of a rectangular portion 1*a* contacts the rear surface of a brim 13 under an opening 11.

With forward motion of the lower portion of the handle 1, right and left handle holding portions 16,16 turn forward against force of a torsion coil spring 17 with corner-cutout-flat portions 1*f*,1*f* of the handle 1. With rotation of the right and left operating rods 15,15, right and left projections 25,25 press the upper ends of the right and left arms 27,27 rearward to allow the operating shaft 26 to rotate, so that the lower ends of the right and left bent portions 26*a*,26*a* go forward.

With forward rotation of the bent portion 26*a*, the arm 31 of the latch 29 is pushed forward and each of the latches 29 turns to the disengaged position in the right side of FIG. 10*b* to enable a drawer 2 to be pulled forward.

In FIG. 9C, when an upper operating portion 1*e* of the handle 1 is pulled, the upper holding portions 16,16 of the operating rods 15,15 are turned forward with upper corner-cutout-flat portions 1*f*,1*f*. So, in FIG. 10B, when left-side operating portion 1*e* of the handle 1 is pulled, upper and lower holding portions 16,16 of the left-hand operating rod is turned forward with left-hand upper and lower corner-cutout-flat portions 1*f*,1*f* of the handle 1. When the right-hand operating portion 1*e* of the handle 1 is pulled, upper and lower holding portions 16,16 of the right-hand operating portion 15 is turned forward with right-hand upper and lower corner-cutout-flat portions 1*f*,1*f* of the handle 1. Thus, one of the arms 27,27 is pressed rearward with the projection 25 of one of the operating rods 15, and then, as well as the embodiment in FIG. 9B, each of the latches 29 is turned to the disengaged position to enable the drawer 2 to be pulled forward.

Figure 11:
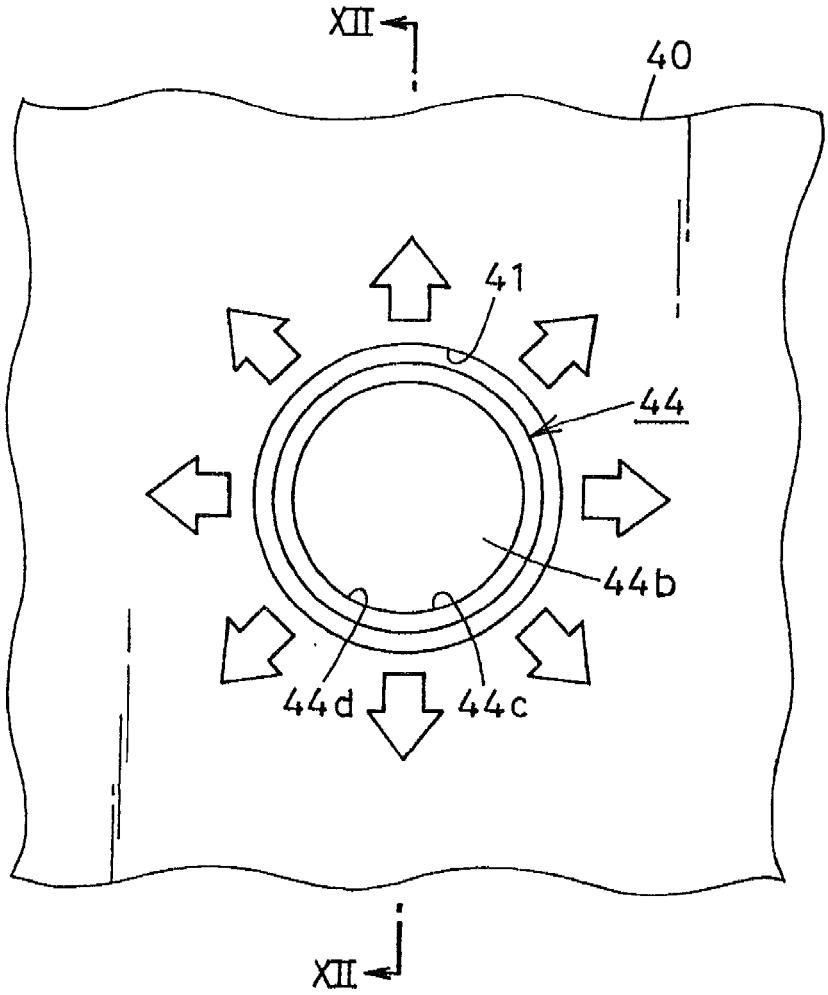
FIG. 11 is a front view of a handle in a door in the third embodiment according to the present invention.
Figure 12:
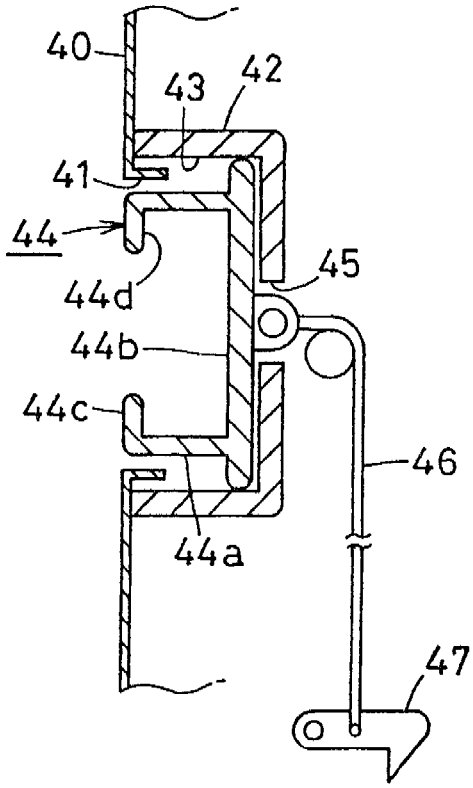
FIG. 12 is a vertical sectional side view taken along the line XII-XII in FIG. 11.
Figure 13:
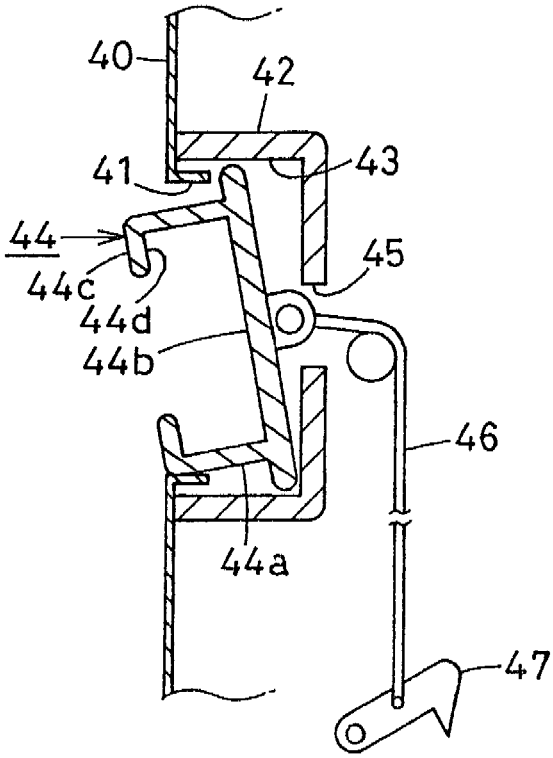
FIG. 13 is a vertical sectional side view similar to FIG. 12 when the upper part of the handle is pulled.

FIGS. 11-13 show a door including the third embodiment of the present invention.

In the front panel of the door 40, a circular opening 41 is formed. A cylindrical storage case 42 forms a handle storage portion 43.

In the handle storage case 42, a circular rear end portion 44*b* having nearly the same size as the inner section of the handle storage case 42 is fixed to the rear end of a cylindrical portion 44*a*. An inward projection 44*c* is provided at the front end of the cylindrical portion 44*a*. In a handle 44, the inward projection 44*c* is used as an operating portion 44*d*. The front end of the cylindrical portion 44*a* faces an opening 41. The rear end portion 44*b* can be slightly tilted from a rest position where it contacts the rear wall of the handle storage case 42.

In the middle of the rear surface of the rear end portion 44*b*, one end of a wire 46 is mounted through an opening 45 in the middle of the handle storage case 42. The other end of the wire 46 is coupled to the middle of a turning latch 47. The latch 47 is able to turn between a rest position in FIG. 12 and a working position in FIG. 13 and is urged toward the rest position by urging means (not shown).

In the embodiment, the wire 46 connects the handle 44 to the latch 47. When the handle 44 is tilted in any direction from the rest position, the wire 46 is pulled to turn the latch from the working position in FIG. 12 to the rest position in FIG. 13.

Figure 14:
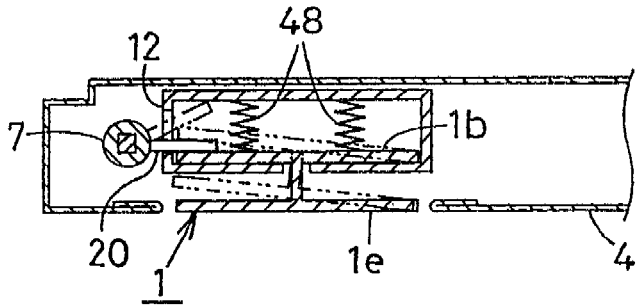
FIG. 14 is a horizontal sectional plan view of a handle of a door in the fourth embodiment according to the present invention.

FIG. 14 is a door including the fourth embodiment of the present invention.

In the embodiment, a brim 1*b* of a handle 1 is urged forward by compression springs 48,48 in a handle storage case 12 to press any one of upper, lower, left-hand and right-hand edges of a rectangular or circular operating portion 1*e* at the front end of the handle 1. So the operating portion 1*e* and brim 1*b* is tilted from a rest position where the operating portion 1*e* and brim 1*b* are in parallel with the front surface of the door 4 to a working position where the handle 1 is tilted. The edge of the brim 1*b* which moves rearward allows an arm 20 of a latch shaft 7 or a handle holding portion 16 of an operating rod 15 to turn rearward to release latching.

The latch shaft 7 turns in a direction contrary to that in FIG. 7 to release latching.

Figure 15:
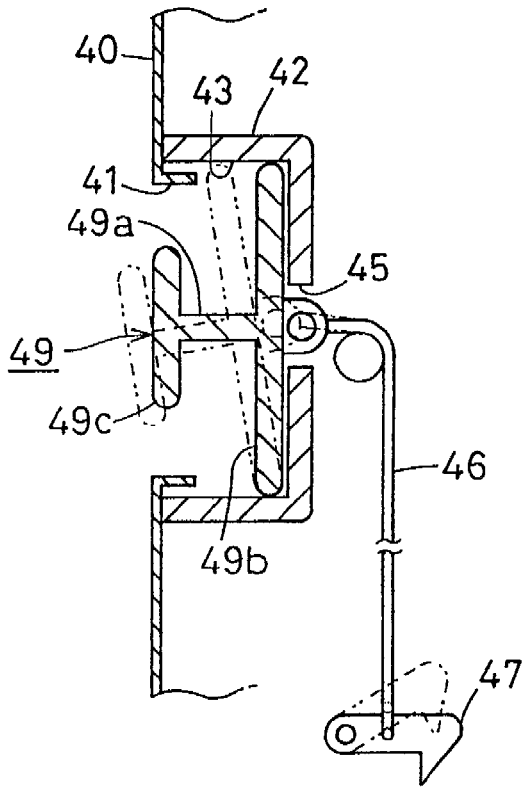
FIG. 15 is a vertical sectional side view of a handle of a door in the fifth embodiment according to the present invention.

FIG. 15 shows a door including the fifth embodiment of the present invention.

In the embodiment, the handle 44 in the third embodiment is replaced with a handle 49 in which a circular rear end plate 49*b* which fits in a handle storage case 42 is fixed to the rear end of a short shaft 49*a* and a circular operating portion 49*c* projects from the front end of the shaft 49*a*.

Figure 16:
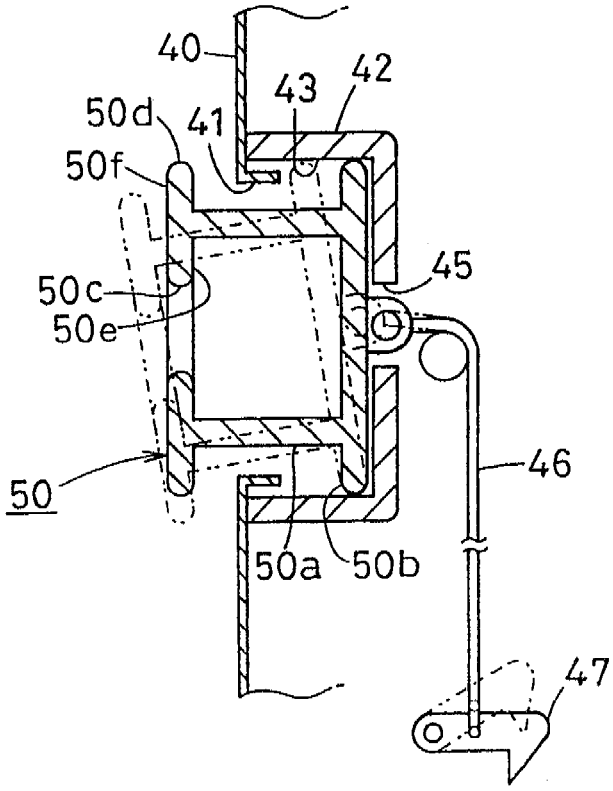
FIG. 16 is a vertical sectional side view of a handle of a door in the sixth embodiment according to the present invention.

FIG. 16 is a door including the sixth embodiment according to the present invention.

In the embodiment, the handle 44 in the third embodiment is replaced with a handle 50 to which a circular rear end portion 50*b* which fits in a handle storage case 42 is fixed in the inside of a handle storage case 42 and an inward projection 50*a* and an outward projection 50*d* are provided at the front end of the cylindrical portion 50*a* to form an inward operating portion 50*e* and an outward operating portion 50*f*.

The other structure is the same as those in the third embodiment.

Figure 17:
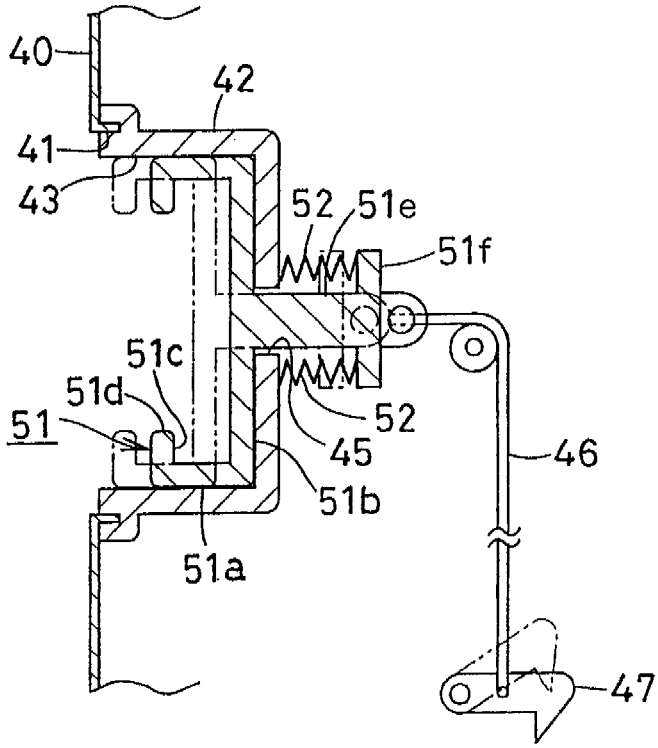
FIG. 17 is a vertical sectional side view of a handle of a door in the seventh embodiment according to the present invention.

FIG. 17 shows a door including the seventh embodiment according to the present invention.

In the embodiment, the handle 44 in the third embodiment is replaced with a handle 51.

In the handle 51, a cylindrical portion 51*a* which fits in the handle storage case 42 is closed by a rear end portion 51*b* and an inward projection 51*c* is provided at the front end of the cylindrical portion 51*a* to form an operating portion 51*d*. A shaft 51*e* projects rearward from the middle of the rear end of the handle storage case 42 through an opening 45 in the middle of the rear end of the handle storage case 42. The shaft 51*e* is urged rearward by a compression spring 52 between a spring retainer 51*f* and the rear end of the handle storage case 42. The rear end of the shaft 51*e* is coupled to a wire 46.

From any one of upper, lower, right-hand and left-hand directions, a hand is brought close to the handle 51 and the projection 51*c* is pulled by a finger to allow the handle 51 against force of the compression spring 52 to move from a rest position shown by solid lines to a working position shown by dotted lines forward to enable the wire 46 to be pulled thereby releasing latch surely.

Figure 18:
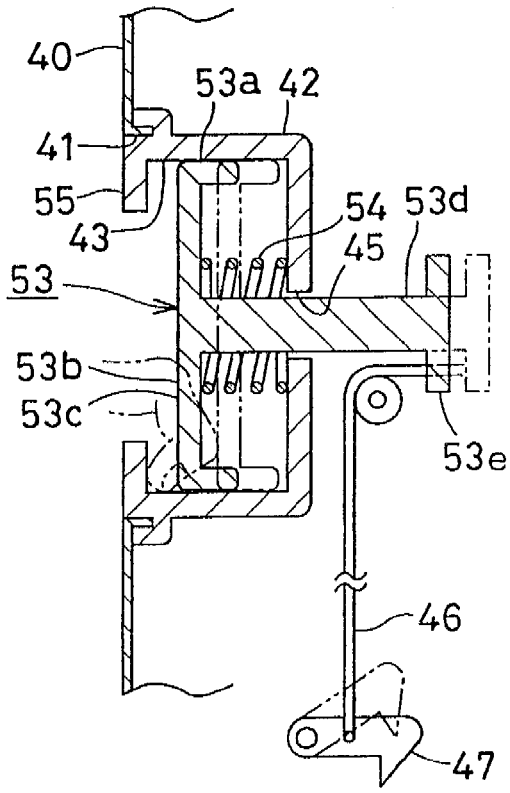
FIG. 18 is a vertical sectional side view of a handle of a door in the eighth embodiment according to the present invention.

FIG. 18 shows a door including the eighth embodiment according to the present invention.

In the embodiment, the handle 44 in the third embodiment is replaced with a handle 53.

In the handle 53, a front end of a cylindrical portion 53*a* which fits in a handle storage case 42 is closed by a front end plate 53*b* to form an operating portion 53*c*. A shaft 53*d* which extends from the middle of the rear surface of a front end plate 53*b* projects rearward through an opening 45 in the middle of the rear end of the handle storage case 42. One end of a wire 46 is mounted to the front surface of a rear end portion 53*e* of the shaft 51*d*. The shaft 53*d* is urged anytime by a compression spring 54 between the rear surface of the front end portion 53*b* and the bottom of the handle storage case 42.

An inward flange 55 is provided from the front end of the handle storage case 42. The first or second joint of a finger is engaged on the projection 55 allows the operating portion 53*c* of the handle 53 to move rearward.

The other structure is the same as those in the third embodiment.

From any one of upper, lower, right-hand and left-hand directions, a hand is brought close to the handle 53 and a finger is engaged on the projection 55 at the front end of the handle storage case 42. The first or second joint of the finger presses the operating portion 53*c* at the front end of the handle 53 rearward to allow the handle 53 by leverage to move from the rest position in solid lines to the working position in dotted lines against force of the compression spring 54 to enable the wire 46 to be pulled, thereby releasing the latch.

FIGS. 19-22 show a door including the ninth embodiment of the present invention.

Figure 3:
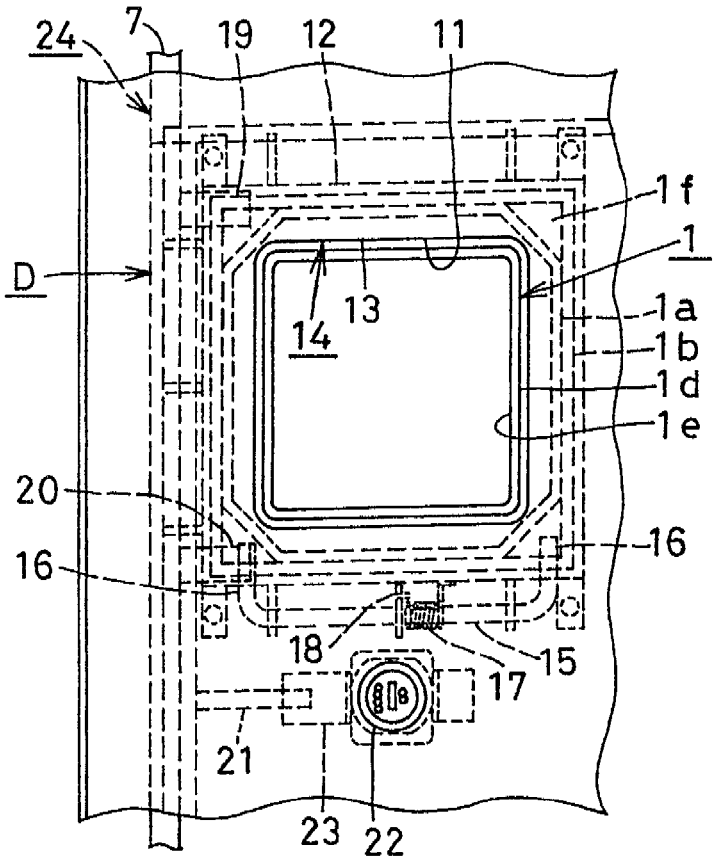
FIG. 3 is an enlarged front view of a handle of the door of the cabinet B.
Figure 4:
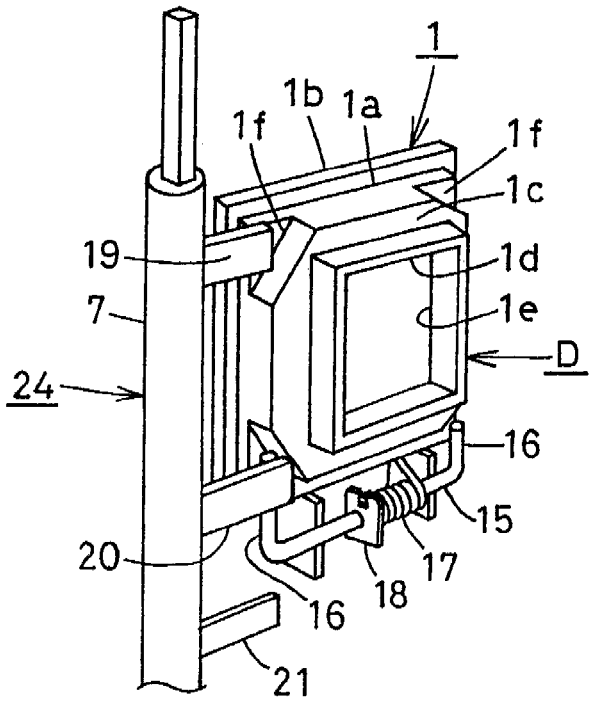
FIG. 4 is a perspective view thereof.
Figure 5:
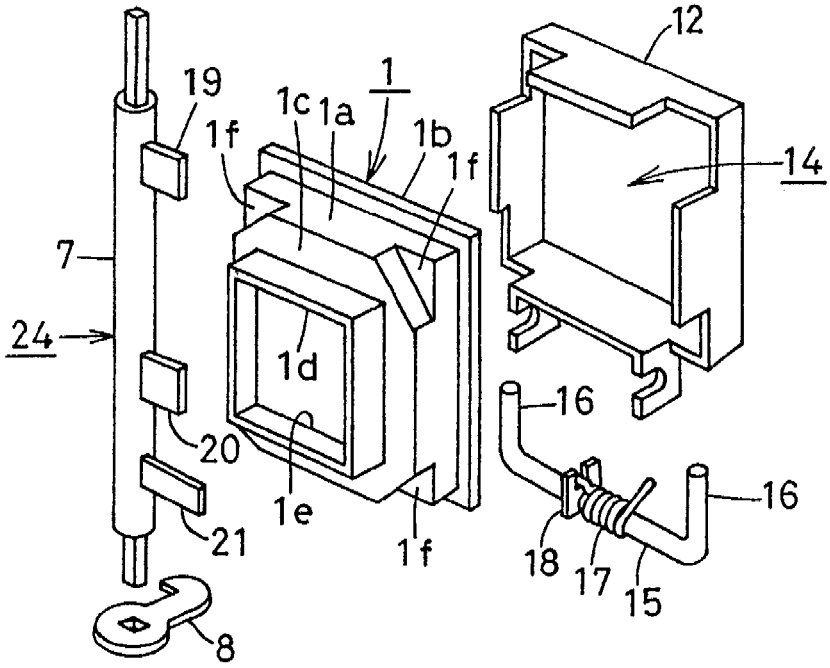
FIG. 5 is an exploded perspective view thereof.
Figure 19:
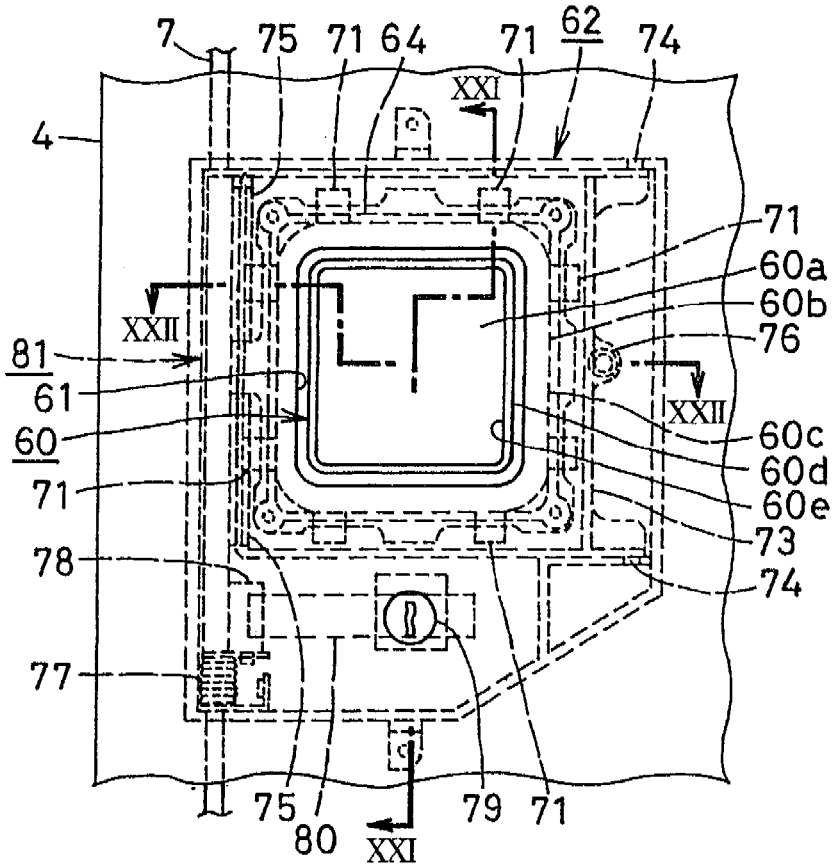
FIG. 19 is a vertical sectional side view of a handle of a door in the ninth embodiment according to the present invention.
Figure 20:
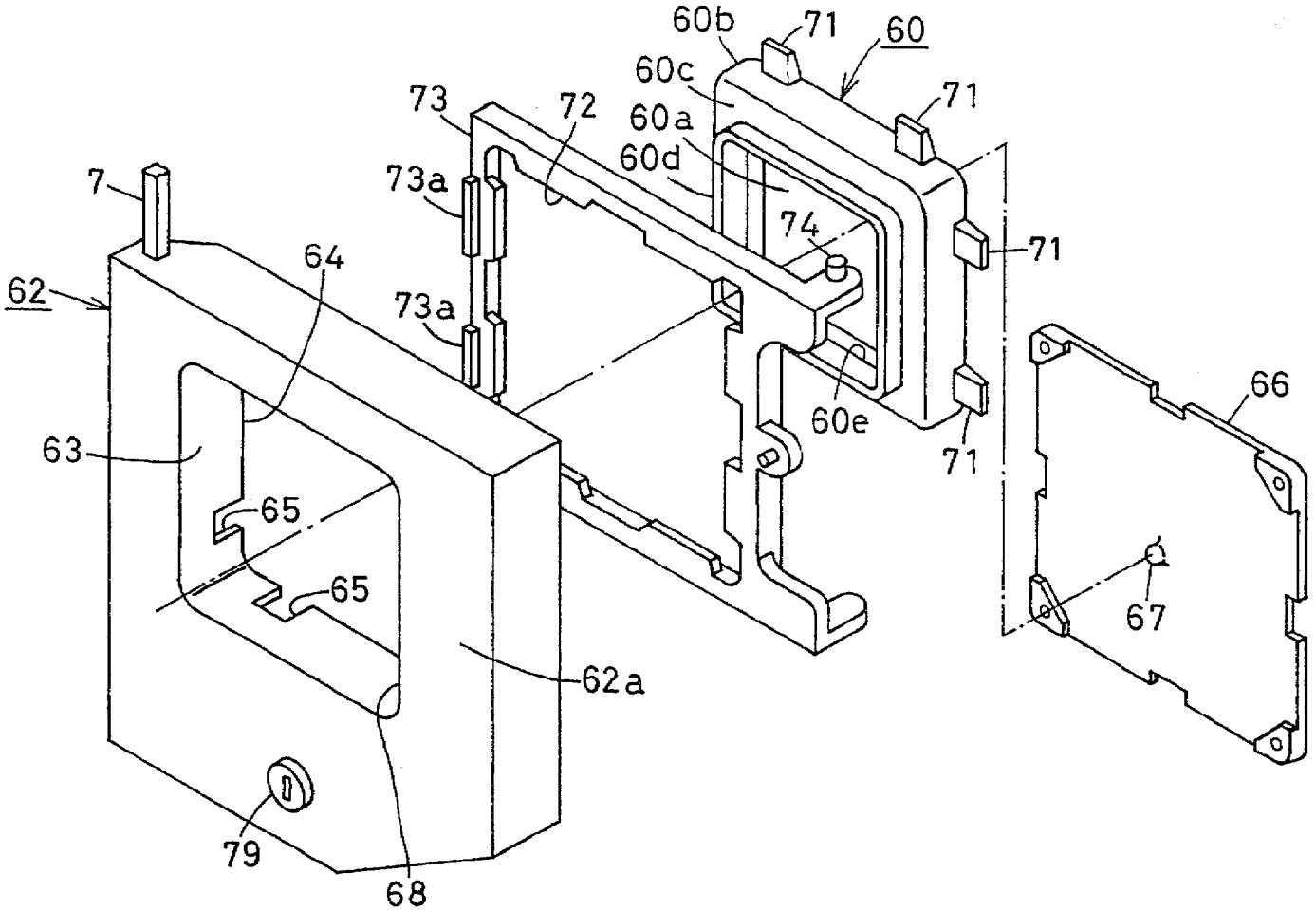
FIG. 20 is an exploded perspective view thereof.

A door 4 in FIG. 19 is similar to that in FIG. 3. The right-hand door 4 is pivotally mounted to the right side of the housing 6 of the cabinet B in FIG. 1 with a hinge (not shown).

The door 4 is equipped with what are similar to the latch shaft 7 and latch 8 in FIG. 2. Illustration and description thereof are the same as those in the first embodiment and omitted.

In FIGS. 19-22, a square opening 61 is formed to operate a handle 60 in the middle of a front panel of the right-hand door 4. Behind the opening 61, a box-like thin handle storage case 62 having a square opening 63 is provided.

A rectangular guide frame 64 is disposed on the front edge surrounding the opening 63 in the handle storage case 62. Two rectangular grooves 65,65 are formed in each side of the guide frame 64.

A vertical closing plate 66 is fixed to the rear end of the guide frame 64 with screws at four corners, and a hemispherical projection 67 is provided at the center of the front surface of the closing plate 66.

A handle storage portion 68 comprises the opening 61 of the door 4, handle storage case 62 and closing plate 66.

A handle 60 comprises a vertical square base 60*a* having a thicken portion, a rectangular portion 60*b*; an inward portion 60*c*; and a rectangular projection 60*d*. The inward portion 60*c* and the projection 60*d* form an operating portion 60*e*.

The rear surface of the middle thicken part of the base 60*a* has a hemispherical hole 69 in which the hemispherical projection 67 engages. The hemispherical projection 67 and hemispherical hole 69 form a spherical bearing 70. The handle 60 is pivotally mounted to the door 4 to tilt in all radial directions including up-and-down and right-and-left on the hemispherical projection 67 from the rest position where the base 60 is in a substantially upright position. In order that the handle 50 may tilt at the same angle in all radial directions, the rear surface of the handle 60 the top of which is the hemispherical hole 69 is conically shaped.

The hemispherical projection 67 may be provided on the rear surface of the handle 60, and the hemispherical hole 69 may be formed in the middle of the front surface of the closing portion 66.

Two projections 71,71 are provided on each of the upper, lower, right-hand and left-hand outer peripheral surfaces of the rectangular portion 60*b* of the handle 60 and project to the outside through the two grooves 65,65 of the guide frame 64.

In the right side of the handle storage case 62, the right side of an operating plate 73 is pivotally mounted with vertical shaft 74,74, and has a square opening 72 through which a guide frame 64 and handle 60 therein engages.

A pair of engagement portions 73*a*,73*a* is provided on the left side of the operating plate 73 and contacts the rear surface of a pair of upper and lower arms 75,75 projecting from a latch shaft 7 of the handle storage case 62.

On the rear surface of the operating plate 73, the upper, lower, right and left projections 71,71 contact. When the handle 60 is in the rest position, the operating plate 73 is in a rest position where all the projections 71 contact the rear surface of the operating plate 73 in parallel with the base 60*a* of the handle 60.

From this position, the upper, lower, right and left operating portions 60*e* of the handle 60 is pulled to allow the handle 60 to tilt into any working position. So the operating plate 73 is turned forward to the working position with any one of the projections 71. With the engagement portions 73*a*,73*a*, the arms 75,75 are pushed forward. Thus, in FIG. 2, the latch shaft 7 and latch 8 turn to the disengaged position where the latch 8 is released from the engagement portion 10.

In FIG. 22, a compression spring 76 is disposed between the front surface of the operating plate 73 and a front portion 62*a* of the handle storage case 62. By the compression spring 76, the operating plate 73 is urged toward the rest position any time, and the handle 60 is urged toward the rest position since all the projections 71 of the handle 60 are pushed.

Specifically, by the single compression spring 76, the operating plate 73 and the handle 60 are both urged toward the rest position.

At the left side of the handle storage case 62, there is a torsion coil spring 77 for urging the latch 8 toward the engagement position where the latch 8 engages with the engagement portion 10 in FIG. 2 and for urging the operating plate 72 toward the rest position.

Another arm 78 projects from the latch shaft 7 under an arm 75. A cylinder lock 79 is mounted to the handle storage case 62 and exposed on the front surface of the door 4. A key (not shown) is inserted into the cylinder lock 79 to move a dead bolt 80 back and force. The left end of the dead bolt 80 goes into a turning track of the arm 80 for locking and gets out of the track for unlocking.

In the embodiment, there is a connecting unit 81 where the latch 8 moves to the disengaged position where the housing 6 leaves the engagement portion 10 when the latch shaft 7 from which the arms 75,75 project allows the operating plate 73 and the latch 8 to move to the working position of the operating plate 73. A latch device comprises the latch 8, connecting unit 81, handle storage case 62, handle 60 and operating plate 73.

How to operate the ninth embodiment will be described.

Figure 21A:
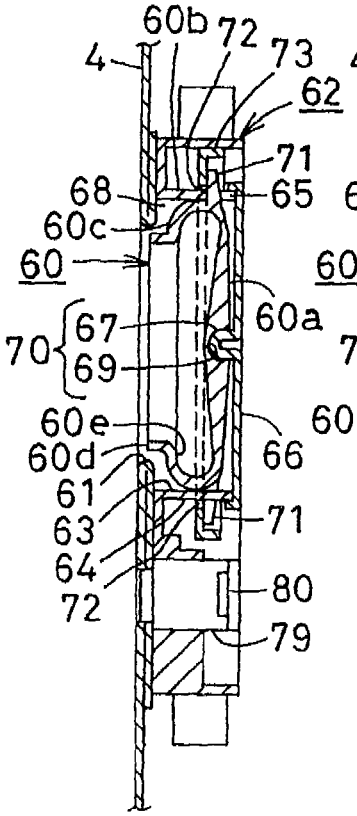
FIG. 21A is a vertical sectional side view taken along the line XXI-XXI in FIG. 19 when the handle is not operated.
Figure 22A:
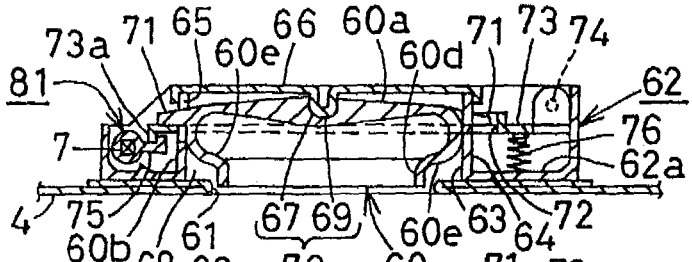
FIG. 22A is a vertical sectional plan view taken along the line XXII-XXII in FIG. 19 when the handle is not operated.

When the handle 60 does not work, the handle 60 is in the rest position in FIGS. 21A and 22A. The latch 8 and latch shaft 7 are in the engagement position as shown by the solid lines in FIG. 2.

Figure 21B:
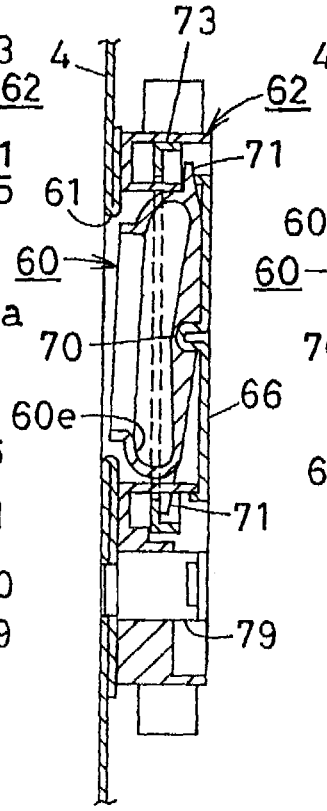
FIG. 21B is a vertical sectional side view taken along the line XXI-XXI in FIG. 19 when the lower part of the handle is pulled.

From this state, in FIG. 21B, when the lower operating portion 60*e* is pulled, the handle 60 tilts rearward on the hemispherical projection 67, the operating plate 73 is turned around the shaft 74 with the right projection 71 at the lower end of the handle 60. The arms 75,75 are pushed forward by the engagement portions 73*a*,73*a* to allow the latch shaft 7 and latch 8 to turn to the disengaged position as shown by dotted lines in FIG. 2 to allow the door 4 to open.

Figure 21C:
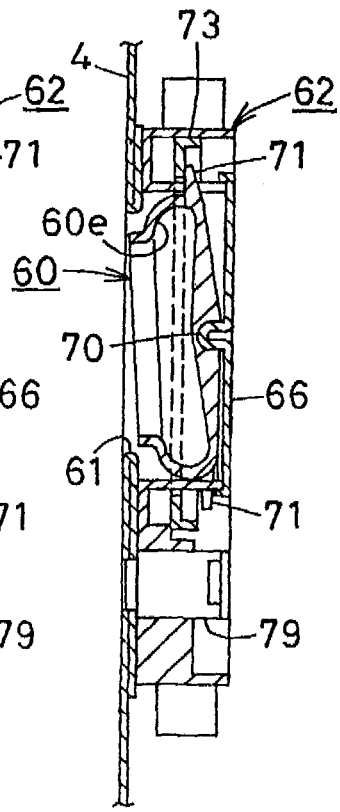
FIG. 21C is a vertical sectional side view taken along the line XXI-XXI in FIG. 19 when the upper part of the handle is pulled.

In FIG. 21C, when the upper operating portion 60*e* of the handle 60 is pulled, the handle 60 tilts forward about the hemispherical projection 67. With the upper right projection 71 of the handle 60, the operating plate 73 turns to the working position about the shaft 74. With movement of the engagement portions 73*a*,73*a*, the arms 75,75 are pushed forward to allow the latch shaft 7 and latch 8 to turn to the disengaged position as shown by the dotted lines to allow the door 4 to open.

Figure 22B:
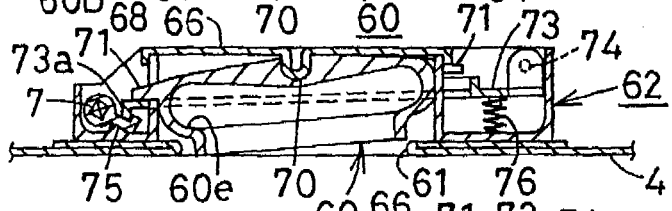
FIG. 22B is a vertical sectional plan view taken along the line XXII-XXII in FIG. 19 when the left part of the handle is pulled.
Figure 22C:
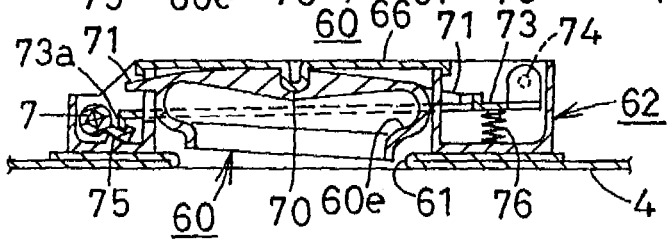
FIG. 22C is a vertical sectional plan view taken along the line XXII-XXII in FIG. 19 when the right part of the handle is pulled.

In FIG. 22B, when the left side operating portion 60*e* of the handle 60 is pulled, the handle 60 turns counterclockwise around the hemispherical projection 67. In FIG. 22C, when the right-side operating portion 60*e* of the handle 60 is pulled, the handle 60 turns clockwise around the hemispherical projection 67. The left-side projection 71 or right-side projection 71 allows the operating plate 73 to turn around the shaft 74 to the engagement position. With motion of the engagement portions 73*a*,73*a*, the arms 75,75 are pressed forward to allow the latch shaft 7 and latch 8 to turn to the disengaged position as shown by dotted lines in FIG. 2 to allow the door 4 to open.

Accordingly, even if any one of the upper, lower, right-hand and left-hand operating portions 60*e* of the handle 60 is pulled, the latch is moved to the disengaged position. Thus, even if the handle 60 is operated from any one of upper, lower, right-hand and left-hand directions, the latch 8 can be released surely, which is convenient.

FIG. 23 shows a door including the tenth embodiment of the present invention.

Figure 23A:
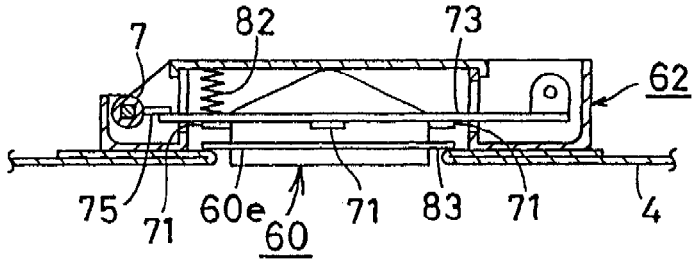
FIG. 23A is a horizontal sectional plan view of a handle in the tenth embodiment according to the present invention when the handle is not operated.
Figure 23B:
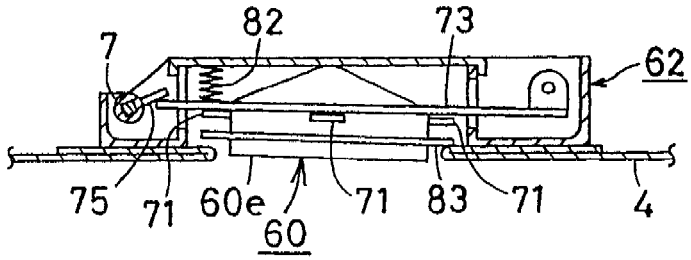
FIG. 23B is a horizontal sectional plan view of the handle in the tenth embodiment according to the present invention when the left-hand part of the handle is pressed rearward.

In this embodiment, as shown in FIG. 23A, an operating plate 73 is urged forward by a compression spring 82 in a handle storage case 62. A handle 60 is urged forward via any one of upper, lower, right and left projections 71 contacting the front surface of an operating plate 73. A brim 83 at the front end of the handle 60 contacts the rear surface of the periphery around an opening 61 and a handle 60 is in a rest position where the front end face of the handle 60 and brim 83 is in parallel with the front surface of the door 4. Any one of upper, lower, right and left edges of rectangular or circular operating portion 60*e* at the front end of the handle 60 is pressed rearward to allow the handle 60 to tilt to a working position in FIG. 23B. The operating plate 73 is turned rearward against the force of a compression spring 82. The left end of the operating plate 73 allows an arm 75 and a latch shaft 7 to turn counterclockwise in FIG. 23A to release latch.

The latch shaft 7 is rotated in a direction opposite to FIG. 22 to release latch.

Figure 24A:
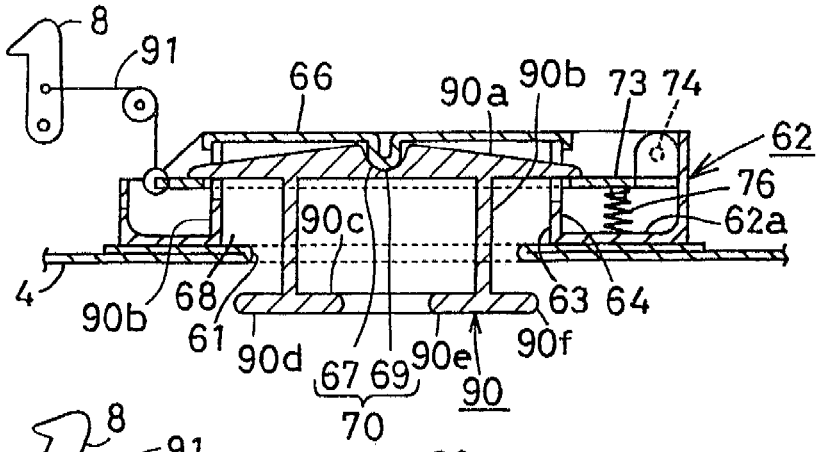
FIG. 24A is a horizontal sectional plan view of a handle in the eleventh embodiment according to the present invention when a handle is not operated.
Figure 24B:
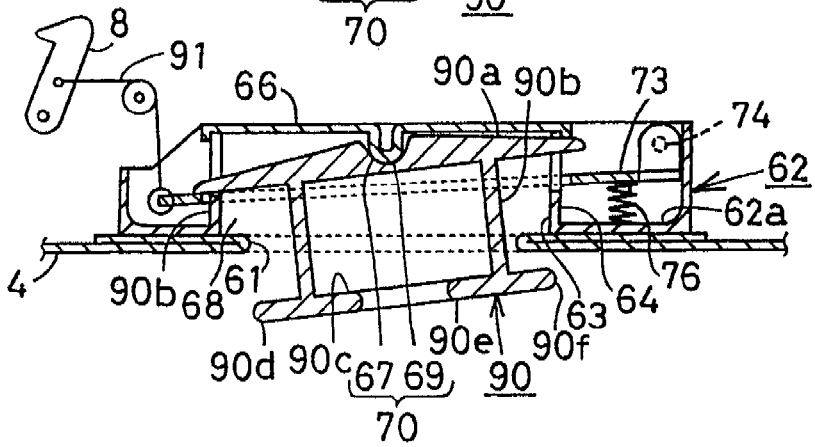
FIG. 24B is a horizontal sectional plan view of a handle in the eleventh embodiment according to the present invention when left-hand part of the handle is pressed rearward.

FIG. 24 shows a door including the eleventh embodiment of the present invention.

In this embodiment, the handle 60 in the tenth embodiment is replaced with a handle 90 in which a cylindrical portion 90*b* is provided on the front surface of a base 90*a* similar to the base 60*a*. An inward projection 90*c* and an outward projection 90*d* are provided on the front end of the cylindrical portion 90*b*.

A wire 91 connects the free end of an operating plate 73 to a latch 8. The operating plate 73 is turned from a rest position in FIG. 24A to a working position in FIG. 24B. The wire 91 is pulled to allow the latch 8 to turn from an engagement position in FIG. 24A to a disengaged position in FIG. 24B.

The others are the same as those in the ninth embodiment.

The foregoing relate to preferred embodiments of the present invention. Variation below may be carried out without departing from the scope of claims.

(a) The right and left handle holding portions 16,16 in the first embodiment extends upward and bends rearward to allow its rear end to contact a middle portion of the brim 1*b* at each side of the handle 1. The handle 1 tilts in any one of upper, lower right and left directions to allow any one of the right and left handle holding portions 16 to press forward with the brim 1*b*. So the upper arm 19 may be omitted.

(b) At least the operating portion 1*e* of the opening 11 and handle 11 in the first and second embodiments may be circular, and the operating portion 1*e* is provided on the whole inner circumference of the handle 1 to enable the handle 1 to be operated not only from upper, lower, right and left directions but also from intermediate oblique directions.

(c) At least the operating portion 44*d* of the opening 41 and handle 44 in the third embodiment may be rectangular.

(d) In the ninth embodiment, between pulling of the left-side operating portion 60*e* of the handle 60 and pulling of the right-side operating portion 60*e* of the handle 60, there is difference in a distance from a forcing point of the handle 60 to the shaft 74 or moment to make operating force of the handle 60 for releasing latch different. To reduce the difference, for example, the right and left projections 71,17 of the handle 60 is omitted. When the left-side operating portion 60*e* of the handle 60 is pulled, the operating 73 is pressed forward with the left projections 71,71 of the handle 60. When the right-side operating portion 60*e* of the handle 60 is pulled, the operating plate 73 is pressed forward with the right projections 71,71 of the handle 60.

(e) At least the operating portion 60*e* for the opening 61 and handle 60 in the ninth embodiment is circular and is provided on the whole inner periphery of the front opening to allow the handle 60 to be operated not only from upper, lower right and left directions but also from intermediate oblique directions.

(f) In the latch device of the drawer 2 in the cabinet A, instead of the latch shaft 7 disposed at the door turning together with the latch 8, the connecting unit comprises an operating shaft disposed on the front panel 3 to allow the latch to press toward the disengaged position with the bent portion at one end; an arm provided in the operating shaft to turn by the free end of the operating plate to turn the latch to the disengaged position via the operating shaft when the operating plate turns from the rest position to the working position.

What is claimed is:

1. A latch device comprising:

a latch configured to be disposed in a door to engage with an engagement portion of a housing when the door closes;

a handle storage case which is configured to be mounted in the door, the door including an opening in the front surface of the door;

a handle in the handle storage case, the handle being configured to be accessible through the opening in the door, the handle having a plurality of projections on an outer periphery thereof and being capable of being inclined in all radial directions around a center of the handle, the handle having at least one elongated surface, the elongated surface configured to move between a substantially vertically-oriented rest position in which the latch engages with the engagement portion of the housing and a working position where the handle is inclined from the vertically-oriented rest position in any one of all the radial directions around the center of the handle to disengage the latch from the engagement portion of the housing;

an operating plate, one end of the operating plate being pivotally mounted in the handle storage case, the operating plate having an opening in which the handle fits;

an urging unit disposed in the handle storage case and urging the handle and the operating plate toward the vertically-oriented rest positions; and a latch shaft configured to be mounted pivotally to the door to rotate with the latch, the latch shaft having an arm and connecting the operating plate with the latch, the handle being pulled through the opening of the handle storage case manually and thus inclined in any one of all the radial directions around the center of the handle from the vertically-oriented rest position to the working position, so that any one of the plurality of projections of the handle turns the operating plate to push the arm of the latch shaft forward and to rotate the latch shaft with the latch to release the latch from the engagement portion of the housing, so that the door opens.

2. The latch device of claim 1, further comprising a closing plate behind the handle in the handle storage case, the closing plate having a hemispherical projection at a center of a front surface, the handle having a hemispherical hole at a center of a rear surface, the hemispherical projection of the closing plate engaging in the hemispherical hole of the handle to allow the handle to tilt in any directions on the hemispherical projection.

3. The latch device of claim 2 wherein each of the plurality of projections abuts the operating plate when the handle and the operating plate are in the respective rest position.

4. The latch device of claim 2 wherein the urging unit comprises a compression spring urging the operating plate toward the rest position.

5. The latch device of claim 4 wherein the connecting unit comprises a latch shaft pivotally mounted to the door to rotate together with the latch, and an arm provided on the latch shaft, the arm turning by a free end of the operating plate when the operating plate turns from the rest position to the working position to allow the latch to disengage from the engagement portion of the housing.

6. The latch device of claim 1, wherein the plurality of projections are distributed on a plurality of peripheral edges of the handle and only a subset of the plurality of projections push the operation plate in response to the handle being pulled to open the door.

* * * * *